US007055265B1

(12) United States Patent
Bathum et al.

(10) Patent No.: US 7,055,265 B1
(45) Date of Patent: Jun. 6, 2006

(54) SANDAL SYSTEM FOR ATHLETIC ACTIVITIES

(76) Inventors: Dale Bathum, 3445 E. Lake Sammamish Shore La. NE., Sammamish, WA (US) 98074; Kevin Xiao, 3526 252nd Pl. SE., Issaquah, WA (US) 98029

( * ) Notice: Subject to any disclaimer, the term of this patent is extended or adjusted under 35 U.S.C. 154(b) by 47 days.

(21) Appl. No.: 10/652,410

(22) Filed: Aug. 29, 2003

Related U.S. Application Data

(60) Provisional application No. 60/406,777, filed on Aug. 29, 2002.

(51) Int. Cl.
*A43B 7/08* (2006.01)

(52) U.S. Cl. ..... 36/3 B; 36/11.5

(58) Field of Classification Search ..... 36/3 R, 36/3 B, 3 A, 11.5, 8.1
See application file for complete search history.

(56) References Cited

U.S. PATENT DOCUMENTS

| | | | | |
|---|---|---|---|---|
| 2,326,198 | A * | 8/1943 | Brandel et al. | 36/3 B |
| 3,012,342 | A * | 12/1961 | Ramirez | 36/3 B |
| 4,910,887 | A * | 3/1990 | Turner et al. | 36/114 |
| 4,939,851 | A * | 7/1990 | Miller | 36/3 B |
| 5,035,068 | A * | 7/1991 | Biasi | 36/3 R |
| 5,400,526 | A * | 3/1995 | Sessa | 36/3 B |
| 5,533,280 | A * | 7/1996 | Halliday | 36/101 |
| 6,014,821 | A * | 1/2000 | Yaw | 36/8.1 |
| 6,418,643 | B1 * | 7/2002 | Yang | 36/101 |
| 6,442,870 | B1 * | 9/2002 | Tsai | 36/11.5 |
| 6,536,137 | B1 * | 3/2003 | Celia | 36/28 |
| 2004/0078996 | A1 * | 4/2004 | Brooks | 36/3 B |

* cited by examiner

*Primary Examiner*—Ted Kavanaugh
(74) *Attorney, Agent, or Firm*—Perkins Coie, LLP

(57) ABSTRACT

A sandal system for athletic activities. The sandal system may include a sandal with a midsole having a cavity contoured to receive an activity-specific insole and a plurality of interchangeable insoles. Each insole of the plurality of interchangeable insoles may be configured for a specific activity, such as running, hiking, walking, water activities, etc. A sandal upper coupled to the insole has one or more straps configured for securing the foot of the wearer in the sandal during athletic activities. The sandal may also include an outsole for providing traction and wearability and a support component for providing support and stability. The outsole, the midsole, and the support component may be configured to include a fluid drainage system including at least one drainage channel and at least one outlet aperture. It is emphasized that this abstract is provided to comply with the rules requiring an abstract. It is submitted with the understanding that it will not be used to interpret or limit the scope or meaning of the claims (37 C.F.R. 1.72(b)).

27 Claims, 12 Drawing Sheets

SANDAL SYSTEM FOR ATHLETIC ACTIVITIES

CROSS-REFERENCE TO RELATED APPLICATION

This application claims priority to U.S. Provisional Application No. 60/406,777, filed Aug. 29, 2002, and herein incorporated in its entirety by reference.

TECHNICAL FIELD

The present invention is directed toward footwear and more particularly toward sandal-style footwear.

BACKGROUND

Activities such as walking, hiking, running, golfing and water sports are typically associated with specialized footwear. For example, conventional running and walking shoes typically have cushioned and flexible soles to promote a natural gait while hiking shoes have stiffer soles to protect against sharp rocks and other objects typically encountered on the trail. Some activity-specific footwear includes features such as soles and uppers that facilitate walking on submerged surfaces (e.g., during kayaking, rafting, beach combing, etc.) and outsoles that provide traction on grass or mud or other slick surfaces (e.g., soccer and golf shoes).

Along with performance features such as those described above, some shoes provide compatibility with customized after-market insoles. These insoles are used to help customize a shoe to provide a better fit or to accommodate wearers that have, for example, flat feet or high arches.

Because of their open nature, conventional sandals, while somewhat versatile within a range of casual uses, neither offer high performance features for sports nor compatibility with customized orthotic insoles. Specialized sandals that do offer specialized performance features are typically geared toward a single sport or activity, which can make them undesirable for other uses. Likewise, sandals that accommodate insoles are primarily limited to casual use (e.g., standing and light walking).

DETAILED DESCRIPTION

Figure 1:
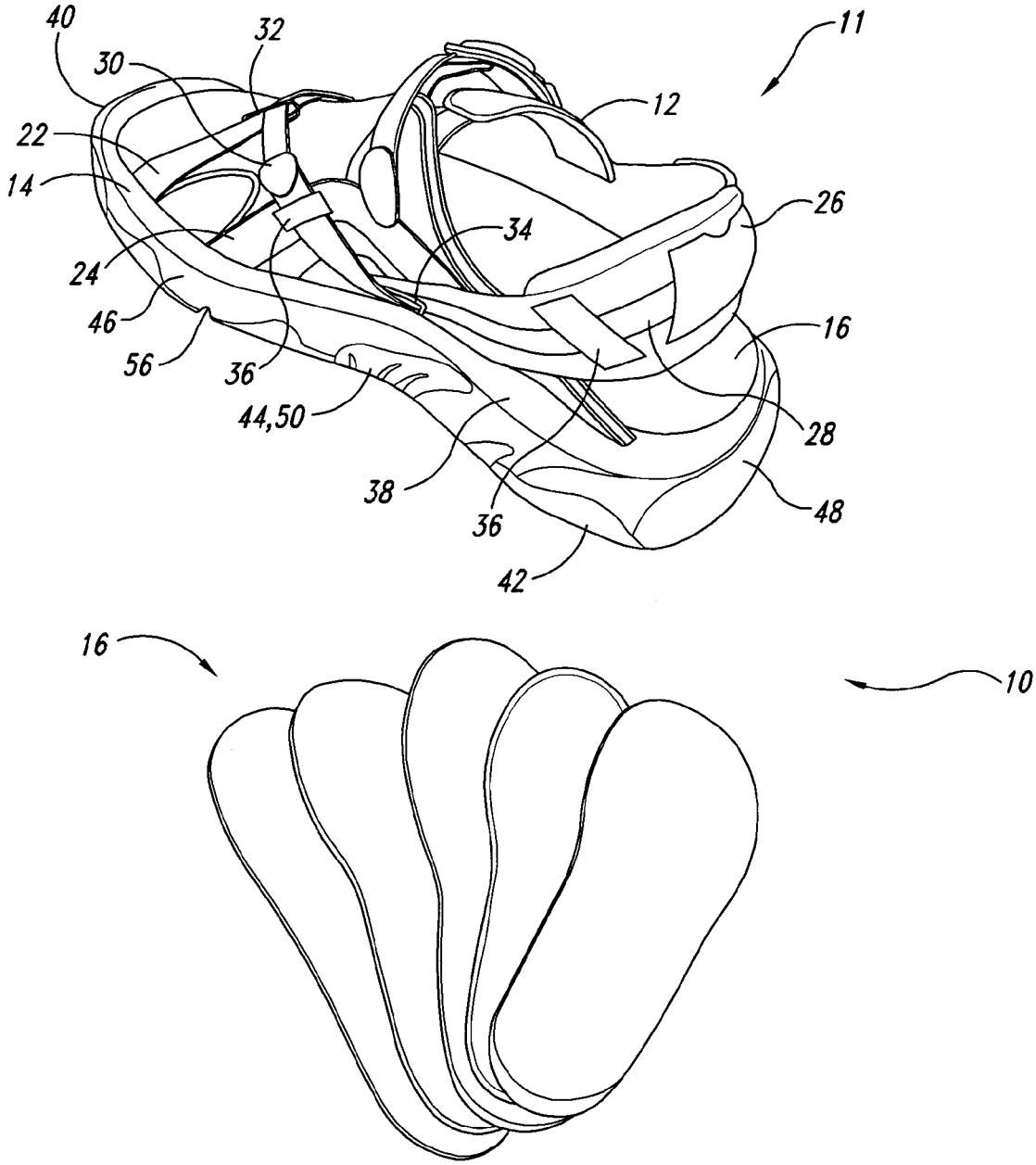
FIG. 1 is an isometric view of a sandal system in accordance with an embodiment of the invention.

In reference to the drawings in detail, FIG. 1 illustrates a sandal system 10 in accordance with one embodiment of the invention. The sandal system 10 includes a sandal 11, best illustrated in FIGS. 1 and 2, and a combination of interchangeable insoles 16. The sandal 11 includes an upper 12, a sole assembly 14 and a removable insole 16, which is tailored to a specific activity (e.g., walking, running, hiking, etc.) and/or foot-type. A front portion 18 of the sandal 11 corresponds to a wearer's forefoot and toes (not shown), while a rear portion 20 of the sandal corresponds to a wearer's heel area (not shown) in the sandal 11.

The upper 12 is shaped and sized to receive and secure the wearer's foot (not shown). The upper 12 of the illustrated embodiment includes a plurality of fixed straps (22, 24 and 26) connected to the sole assembly 14, including front straps 22, lateral/medial straps 24 and a heel strap 26. The upper 12 also includes an adjustable strap 28 or pulley strap. The adjustable strap 28 is configured in combination with the fixed straps (22, 24 and 26) to form an adjustable strap system for comfortably securing the wearer's foot in the sandal 11 during strenuous activities such as hiking, golf, running, swimming or the like.

The adjustable strap 28 has two end portions 30, each being looped around a center ring 32 fixed to one or more of the front straps 22 of the upper 12 and fastened back to a mid portion of the adjustable strap 28. In the illustrated embodiment, a hook-and-loop material, such as Velcro™ is used to fasten the adjustable strap 28 to itself. In alternate embodiments, fasteners such as snaps, hooks, clips, ties, etc. may be used. The adjustable strap 28 extends down both lateral sides of the sandal upper 12 and around the heel strap 26. On each lateral side of the sandal 11, the adjustable strap passes through a keeper 34 secured to the sole assembly 14. The adjustable strap 28 is also secured at various points on the heel strap 26 and lateral/medial straps 24 by passing through various fixed loops 36 or other retention devices.

Figure 17:
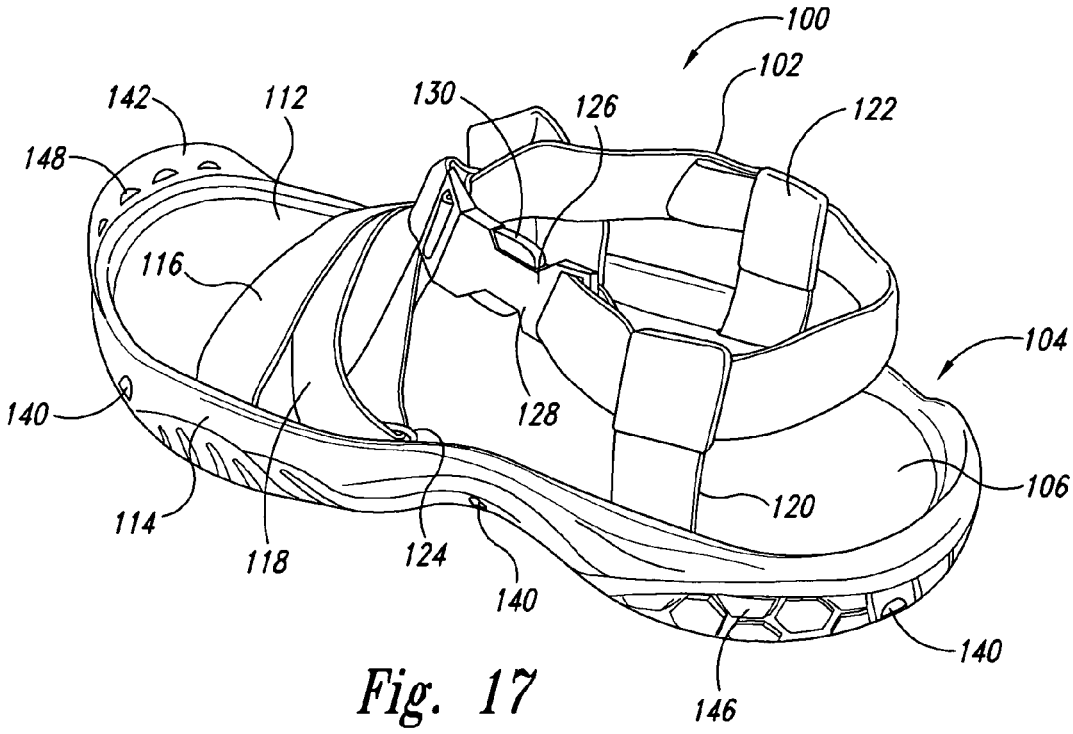
FIG. 17 is an isometric view of a sandal system in accordance with a second embodiment of the invention.
Figure 18:
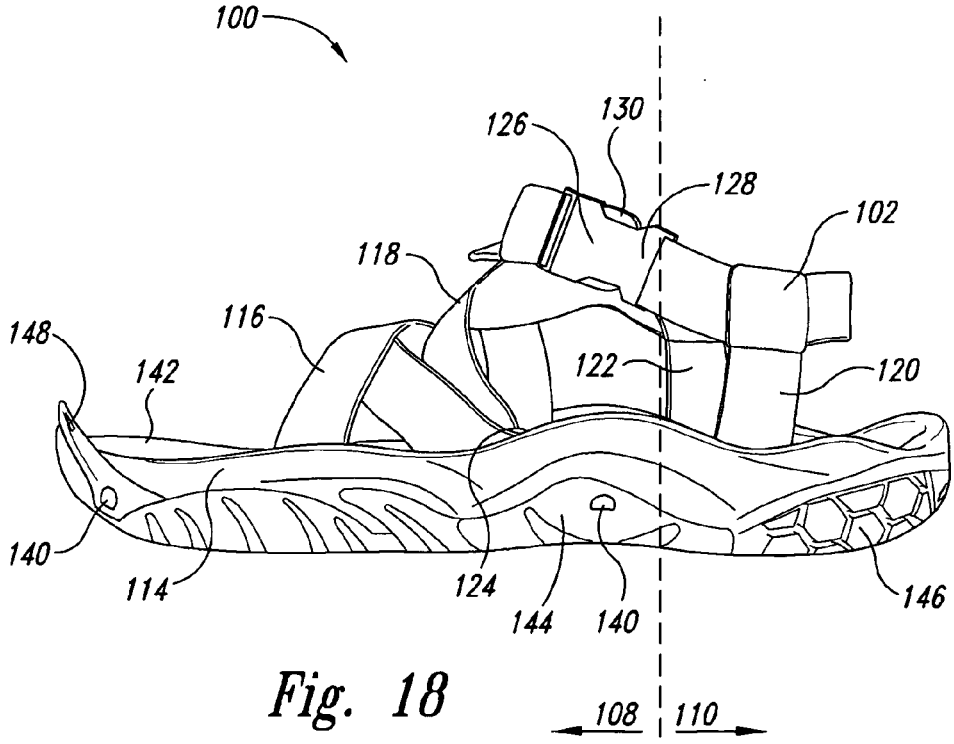
FIG. 18 is a side elevation view of a sandal associated with the sandal system of FIG. 17.

In the illustrated embodiment, when one or both of the end portions 30 of the adjustable strap 28 are pulled back and down toward the rear portion 20 of the sandal, the adjustable strap 28 slides through the center ring 32 to snugly secure the front straps 22 over the instep and forefoot area of the wearer's foot. The adjustable strap 28 also slides through the keepers 34 and loops 36 of the adjustable strap system, thereby pulling the heel strap 26 forwardly and securely against the heel portion of the wearer's foot. The heel strap 26 may be fixed to both lateral/medial straps 24 or to only one of the lateral/medial straps so as to reduce buckling of the heel strap when the adjustable strap 28 is tightened. Accordingly, a single adjustment of the sandal's adjustable strap 28 secures the sandal's upper 12 around the forefoot and heel portion of the wearer's foot, anchoring the wearer's foot evenly and firmly into the sandal 11 for a stable and secure feeling. In an alternate embodiment, the adjustable strap 28 may be securely fixed to the sole assembly 14 and/or fixed straps (22, 24 and 26) at one or more points. In a second alternate embodiment, multiple adjustable straps 28 may be configured to form an adjustable strap system. Yet another embodiment of a strap system is illustrated in FIGS. 17 and 18.

The adjustable strap 28 and fixed straps (22, 24 and 26) of the upper 12 securely hold the wearer's foot in place on the insole 16 on the sole assembly 14. The sole assembly 14 is a molded member having when it is inserted into a contoured cavity 48 molded therein. The contoured cavity 48 is formed by a sidewall 38 and a support surface molded into a midsole component 46 of the sole assembly 14 so as to removeably receive the insole 16. In the illustrated embodiment, the fixed straps (22, 24 and 26) are all secured to the sole assembly 14 inside apertures formed just inside the sidewall 38 on the support surface. This placement of the fixed straps (22, 24 and 26) with respect to the midsole component 46 and the contoured cavity 48 provides additional engagement of the insole 16 when it is inserted into the contoured cavity 48. The sidewall 38 also helps to protect the sides of the insoles, and in some embodiments, protect the sides of the wearer's foot. Similarly, to protect the wearer's toes, a toe guard 40 extends from the front of the sole assembly 14. In some embodiments the toe guard 40 may not be provided or may be removable.

The midsole component 46 of the sole assembly 14 is constructed, at least in part, of a shock-absorbing material such as a Phylon foam material. While Phylon is used to construct the midsole component 46 of the sole assembly 14 in the illustrated embodiment, other materials may be used, including materials such as ethylene vinyl acetate (EVA) foam, polyurethane foam or a combination of materials (e.g., a dual-density sole). As best shown in FIGS. 3 through 6, the midsole component 46 of the sole assembly 14 includes a drainage system 37 that allows water to escape through side and rear portions of the midsole component 46, especially when a perforated or poriferous insole 16 or otherwise water permeable insole designed for aquatic activities (described in more detail below) is inserted into the footbed 48.

Figure 3:
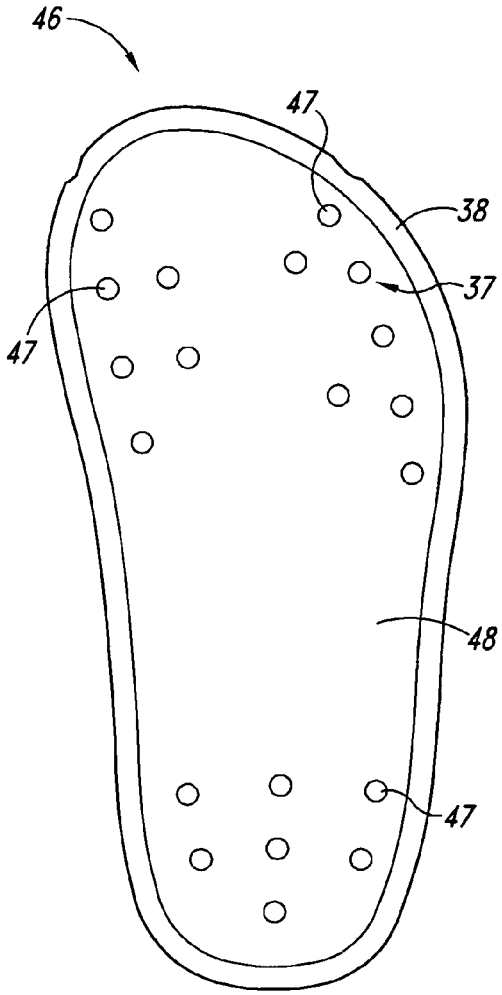
FIG. 3 is an enlarged top plan view of a midsole component of the sandal associated with the sandal system of FIG. 1.
Figure 4:
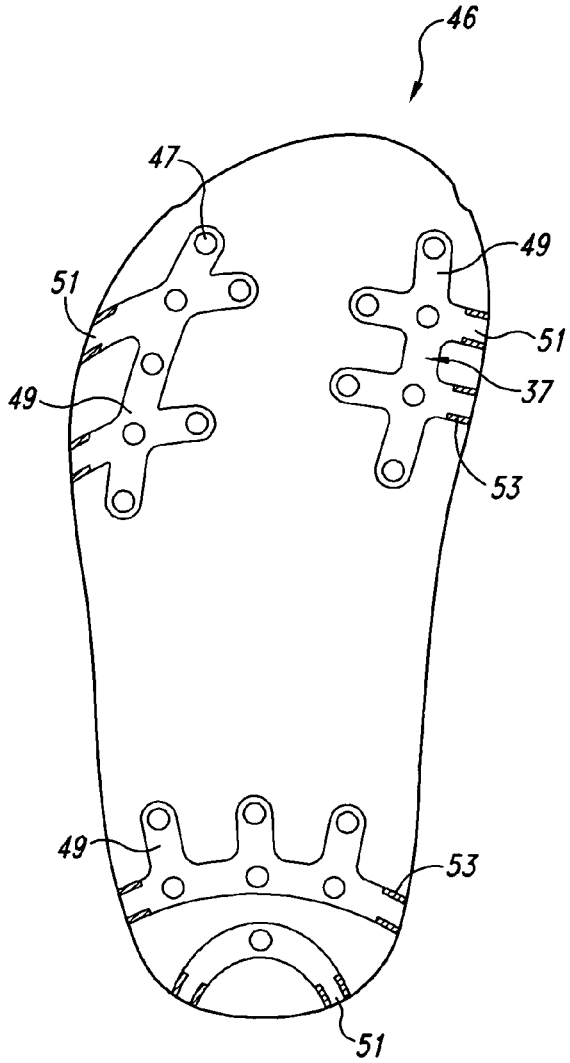
FIG. 4 is an enlarged bottom plan view of the midsole component of the sandal associated with the sandal system of FIG. 1.

As shown in FIGS. 3 and 4, the drainage system 37 includes multiple inlet channels 47 that are approximately vertically oriented in the midsole component 46 (when the longitudinal axis of the midsole component is substantially horizontal). The inlet channels 47 begin at the support surface level of the midsole component 46 and extend downward to approximately midway through the midsole component 46 before joining multiple outlet or drainage channels 49 that are approximately horizontally oriented and extend laterally toward the outside perimeter of the midsole component. Each outlet channel 49 ends in at least one outlet aperture 51. In the illustrated embodiment, the outlet apertures 51 are located on the sides and rear portions of the midsole component 46. Both the inlet channels 47 and the outlet channels 49 are molded into the midsole component 46. The outlet apertures 51 may be reinforced in one or more places with plastic tubes 53 or other reinforcement means. These plastic tubes 53 have sufficient rigidity to help keep the outlet apertures 51 open even when the midsole component 46 is compressed from the weight of the wearer.

As a result of this configuration, water that enters through the inlet channels 47 and into the outlet channels 49 may drain out of the outlet apertures 51 with every step of the wearer. Because of the plastic tubes 53 inserted into the outlet apertures 51, the outlet apertures 51 are kept open while the outlet channels 49 open and close with each step, causing an inward suction to bring the water down and an outward pressure to push the water out. Alternate embodiments (such as the embodiment illustrated in FIGS. 17 through 23) may include other combinations of openings, perforations, or drainage features, or may not include any drainage system 37 at all.

Figure 5:
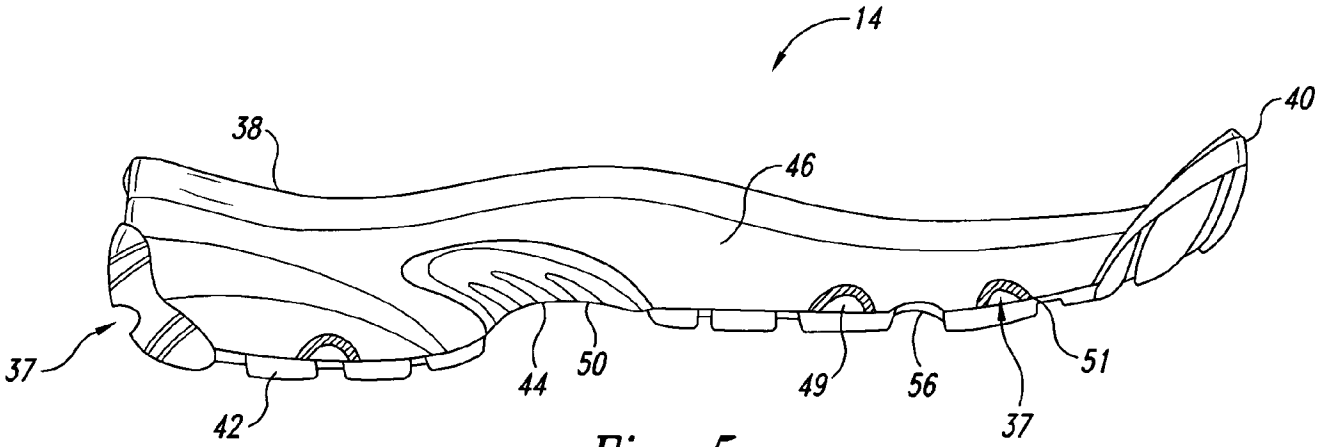
FIG. 5 is an enlarged side elevation view of a sole assembly of the sandal associated with the sandal system of FIG. 1.
Figure 6:
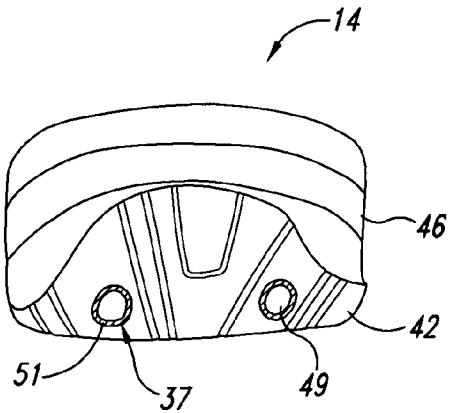
FIG. 6 is an enlarged rear elevation view of the sole assembly of the sandal associated with the sandal system of FIG. 1.
Figure 7:
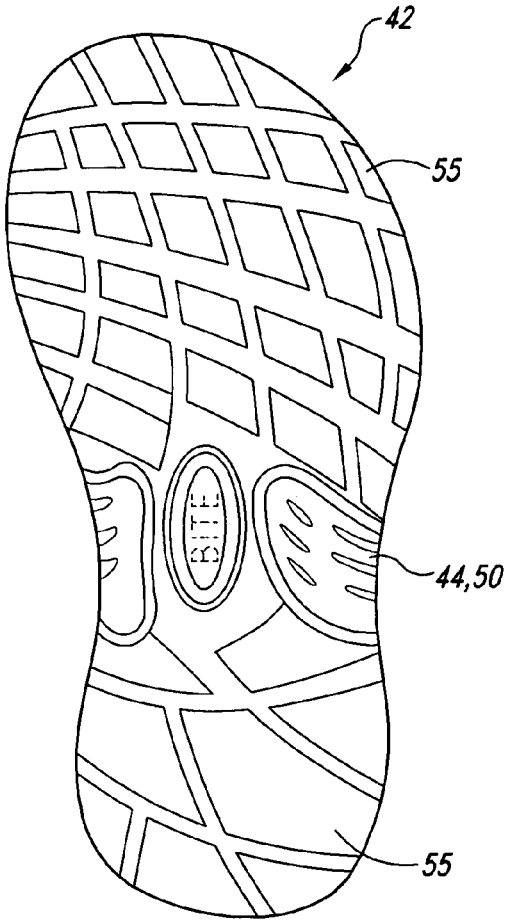
FIG. 7 is an enlarged bottom plan view of an outsole component of the sandal associated with the sandal system of FIG. 1.
Figure 8:
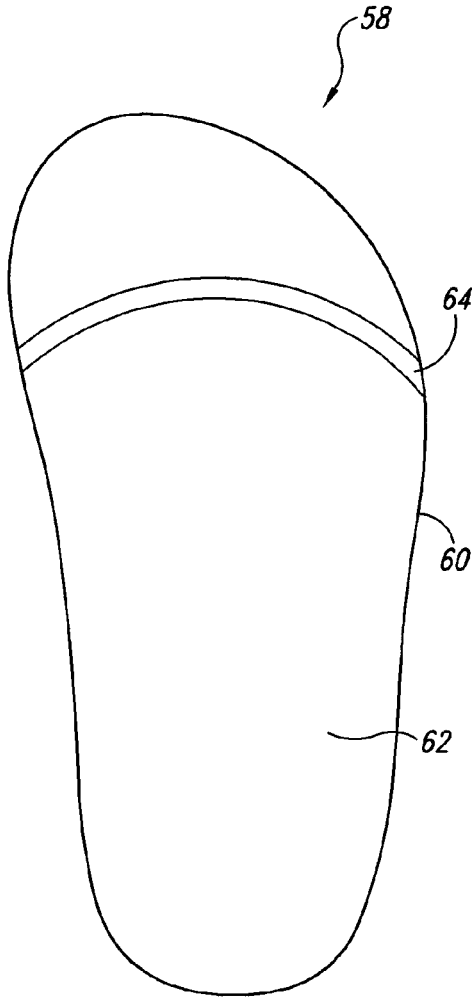
FIG. 8 is an enlarged top plan view of a walking insole for use in the sandal system of FIG. 1.

Along with the midsole component 46, the toe guard 40 and the sidewall 38, the sole assembly 14 also includes an outsole component 42 and a support component 44, best shown in FIGS. 5 and 7. The support component 44 of the sole assembly 14 may consist of one or more support features, such as an arch shank or stabilizer 50 and/or a heel cup (not shown). In the illustrated embodiment, the arch shank 50 is positioned between the midsole component 46 and the outsole component 42 of the sole assembly 14 at a location generally corresponding to the arch area and instep area of the wearer's foot to provide support for the wearer's foot. The arch shank 50 may be constructed of a semi-flexible material that allows for some fore and aft flexion while maintaining appropriate lateral support and arch support. In an alternate embodiment, the support component 44 includes a firmer density material positioned within the midsole component 46 of the sole assembly 14 at the arch area of the wearer's foot, providing additional arch support. The support component 44 generally aids in the flow of the kinetic energy generated by the wearer's motion, allowing the wearer to maintain a flowing smooth stride while walking, running or the like.

The outsole component 42, best shown in FIG. 7, is constructed to provide grip on a variety of surfaces, and may be adhered to at least a portion of the bottom of the midsole component 46 of the sole assembly 14. Outer portions of the arch shank 50 can remain exposed. The outsole component 42 in the illustrated embodiment is a dual-density component (i.e., made of at least two compounds), but other outsole component 42 constructions may be used in alternate embodiments. Dual formula, variable sized traction lugs 55 provide good road, water, and trail traction.

Figure 2:
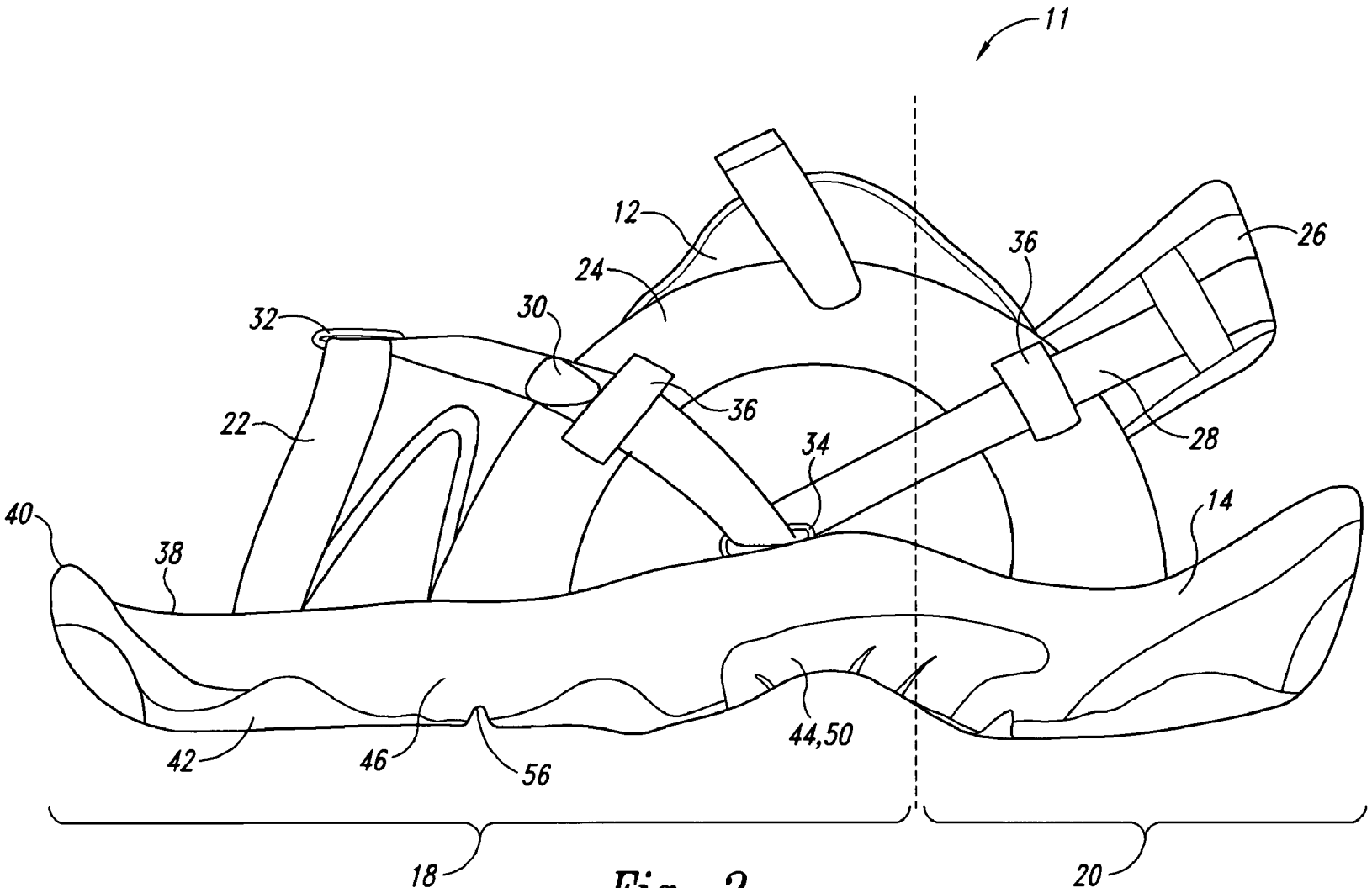
FIG. 2 is an enlarged side elevation view of a sandal associated with the sandal system of FIG. 1.

In the sandal 11 illustrated in FIGS. 1 and 2, a concave flex groove 56 is positioned at the bottom of the sole assembly 14 proximate to the outsole component 42 and extending into the midsole component 46 in an area that corresponds approximately with the ball of the wearer's foot when the sandal is worn. The flex groove 56 extends laterally across the sole assembly 14, oriented with respect to the front and rear portions of the sandal 11. The flex groove 56 adds targeted flexibility to the sole assembly 14, reducing some of the ground reaction force transmitted through the sandal 11 to the wearer's forefoot and providing a smoother toe-off and a natural heel-to-toe-off stride. The outsole component 42 may be bifurcated so that the flex groove 56 remains exposed, allowing for appropriate flexibility and fore-aft rolling action. A dual flex groove may also be used in an alternate embodiment.

FIGS. 8 through 16 show a selection of possible insoles 16 comprising an embodiment of a sandal system 10 in accordance with the present invention. Each insole 16 is designed for a different activity and/or foot type. For example, a walking-specific insole 58, shown in FIG. 8, includes a base with extra cushioning 60 and a leather topsole 62, designed for comfortable walking. The cushioning 60 can be made from various materials, such as polyurethane, and the thickness and density of the insole 58 may vary depending on the amount of cushioning and stability desired. For example, a first wearer may prefer a firmer cushioning that offers medium support while a second wearer may prefer softer and thicker cushioning with slightly less support. The walking-specific insole 58 may also include a toe ridge 64 for increased foot stability.

Figure 9:
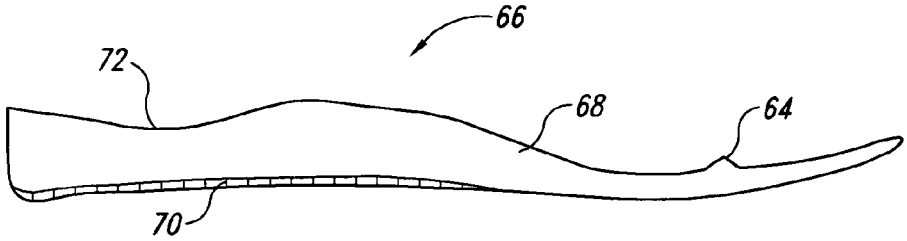
FIG. 9 is an enlarged side elevation view of a hiking insole for use in the sandal system of FIG. 1.
Figure 10:
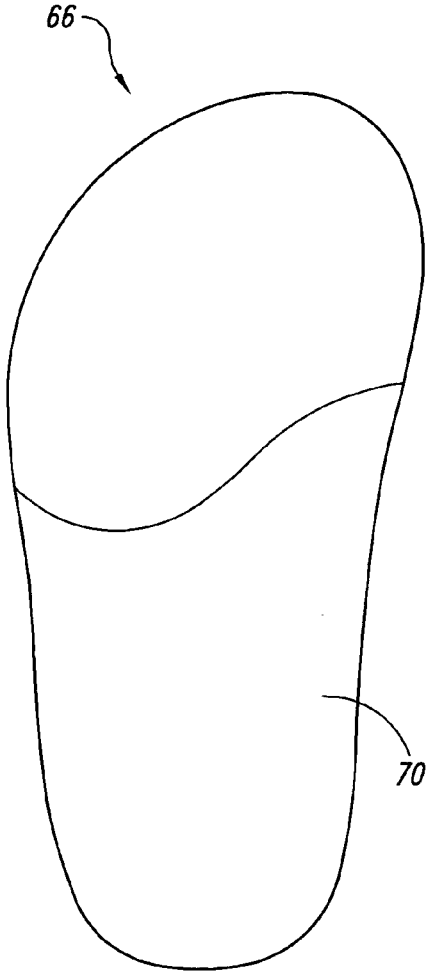
FIG. 10 is an enlarged bottom plan view of a hiking insole for use in the sandal system of FIG. 1.
Figure 11:
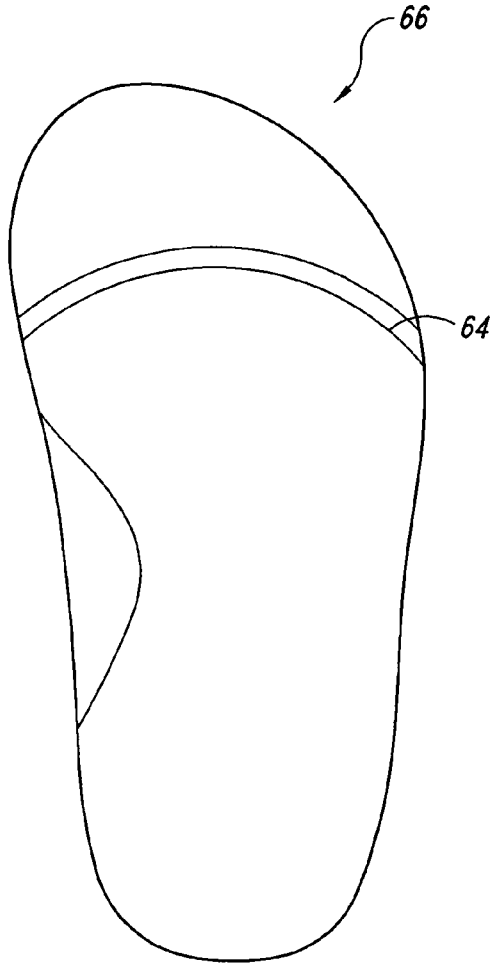
FIG. 11 is an enlarged top plan view of a hiking insole for use in the sandal system of FIG. 1.

A hiking-specific insole 66, shown in FIGS. 9, 10 and 11, has a base with extra cushioning 68 for enhanced shock absorption. The hiking-specific insole 66 adds a stiffer bottom shell layer 70 and a deep heel cup 72 to provide additional lateral support for walking on rough and uneven surfaces. Varying levels of arch support may be offered, as well as features such as a toe ridge 64 for increased foot stability.

Figure 12:
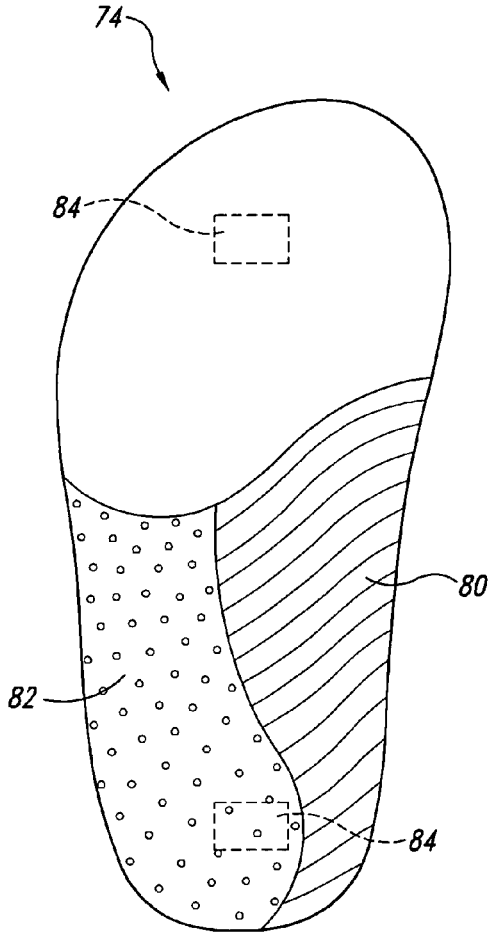
FIG. 12 is an enlarged bottom plan view of a running insole for use in the sandal system of FIG. 1.
Figure 13:
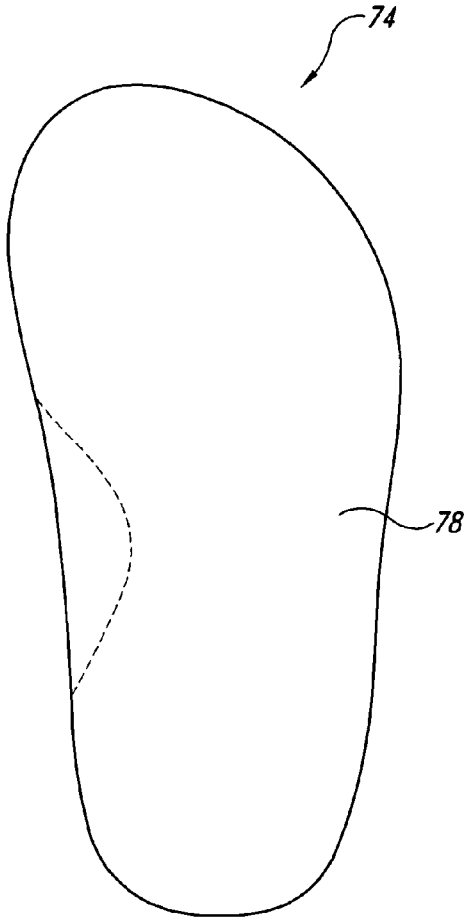
FIG. 13 is an enlarged top plan view of a running insole for use in the sandal system of FIG. 1.

A running insole 74, shown in FIGS. 12 and 13 is designed for supporting a runner's foot, and includes various support features and a lightweight design. The running insole 74 in the illustrated embodiment includes a two-piece lower support component (80 and 82), a heel cushioning layer (not shown) and a topsole layer 78. The two-piece lower support component (80 and 82) provides structure for the insole 74 as well as lateral and arch support, and includes a medial portion 80 and a lateral portion 82. For pronators, the medial portion 82 is firmer than the lateral portion 80 to keep the foot from collapsing inward. For supinators, the lateral portion 80 is firmer than the medial portion 82 to keep the foot from collapsing outward. For neutral runners, the lateral portion 80 and the medial portion 82 are of substantially equal firmness. The two-piece lower support component (80 and 82) also promotes a natural heel-to-toe running gait.

The heel cushioning layer (not shown) of the running insole 74 may consist of a dual hardness heel pad (not shown), including an extra shock-absorbing material such as EVA. The topsole layer 78 may include a material that aids in keeping the foot cool, such as Outlast™. A non-skid material 84, such as rubber or Velcro™ may be placed on the bottom of the insole 74 at one or more locations so that it stays secure on the contoured cavity 48 of the midsole component 46, even while the wearer is engaged in vigorous activity. This non-skid material 84 may be included on any of the insoles 16 in accordance with the invention.

Figure 14:
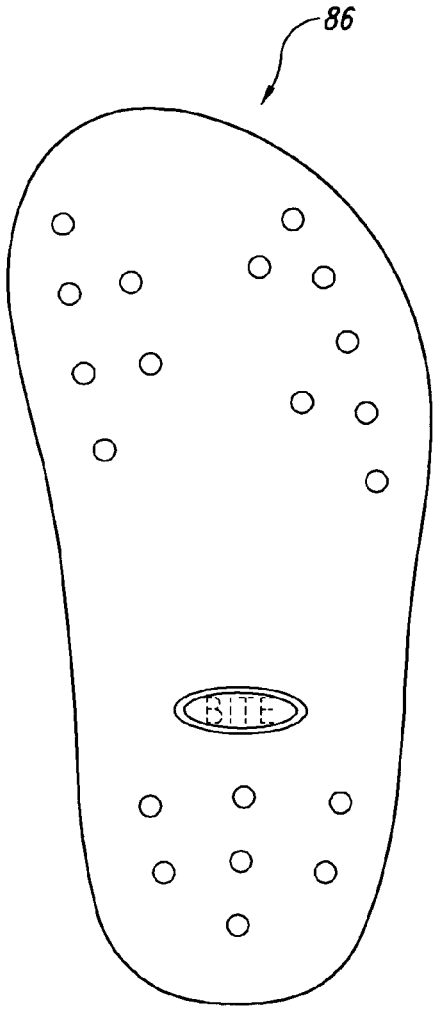
FIG. 14 is an enlarged top plan view of an aquatic insole for use in the sandal system of FIG. 1.

An aquatic-specific insole 86, shown in FIG. 14, includes a poriferous, yet supportive construction that allows water to drain down into the midsole component 46, through the drainage system 37, and out of the sandal 11. The aquatic specific insole 86 may be made from a non-absorbent material that allows it to dry quickly.

Figure 15:
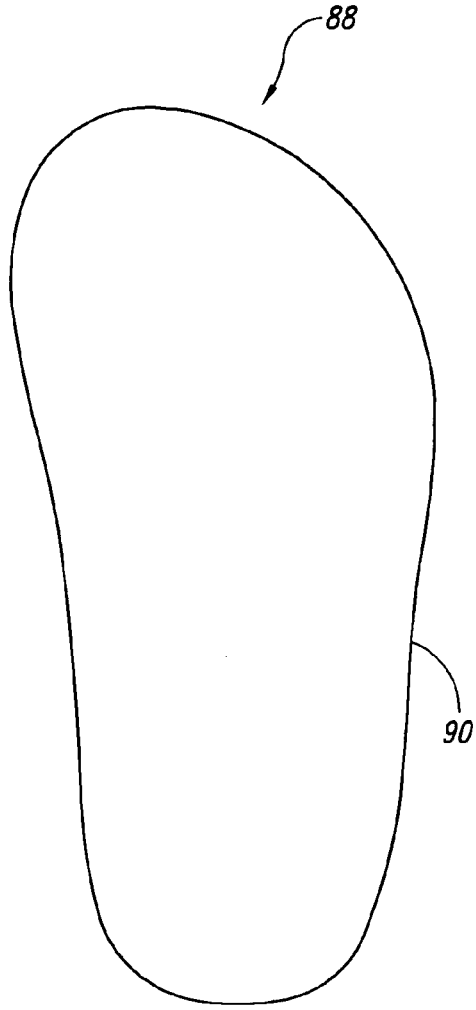
FIG. 15 is an enlarged top plan view of a golf training insole for use in the sandal system of FIG. 1.
Figure 16:
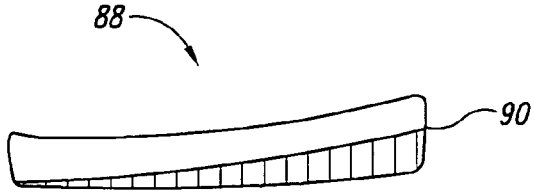
FIG. 16 is an enlarged rear elevation view of a golf training insole for use in the sandal system of FIG. 1.

A golf training insole 88, shown in FIGS. 15 and 16, is designed as a teaching device for golf where the insole 88 has an extra thickness lift (e.g., 10 mm) on the lateral side 90 to give the wearer the feel of keeping his or her weight to the insides of his or her feet.

Along with the insoles shown in FIGS. 8 through 16, a variety of orthotic insoles produced by, for example, a foot specialist, podiatrist, or physical therapist may be used with the sandal system 10. The contoured cavity 48 is shaped and formed in a way to receive and secure any selected one of the insoles, 16, as well as a wide range of custom or orthotic insoles.

In one embodiment, the sandal system 10 is a versatile system for a consumer by providing the sandal 11 along with a combination of the different insoles 16, such as three described above and/or other insoles, as a single package. For example, the sandal system 10 may include the sandal 11 and a running insole, a hiking insole, and a water sports insole. Special-interest sandal systems 10 may also be offered for wearer's with narrower interests. For example, a specialized "runners pack" may include with the sandal a selection of running-specific insoles (e.g., standard, extra-support, trail running, hot-weather), while a "golf lovers" package may include an insole for walking, and multiple insoles of different thicknesses for golf training. Other insoles 16 can be sold separately and added to the sandal system 10 to tailor the system to individual needs.

FIG. 17 illustrates a sandal 100 in accordance with a second embodiment of the invention. Like the sandal 11 of FIG. 1, the sandal 100 includes an upper 102, a sole assembly 104 and a removable insole 106 tailored to a specific activity (e.g., water sports, running, hiking, golf, etc.) and/or foot-type. A front portion 108 of the sandal 100 corresponds to a wearer's forefoot and toes, while a rear portion 110 of the sandal corresponds to a wearer's heel area in the sandal 100. The sole assembly 104 includes an outsole component 146, a support component including an arch shank or stabilizer 144 and a curved forefoot plate 150, and a midsole component 114 constructed, at least in part, of a shock-absorbing material. The sole assembly 104 also includes a contoured cavity that forms a contoured cavity 112 associated with the midsole component 114.

Figure 19:
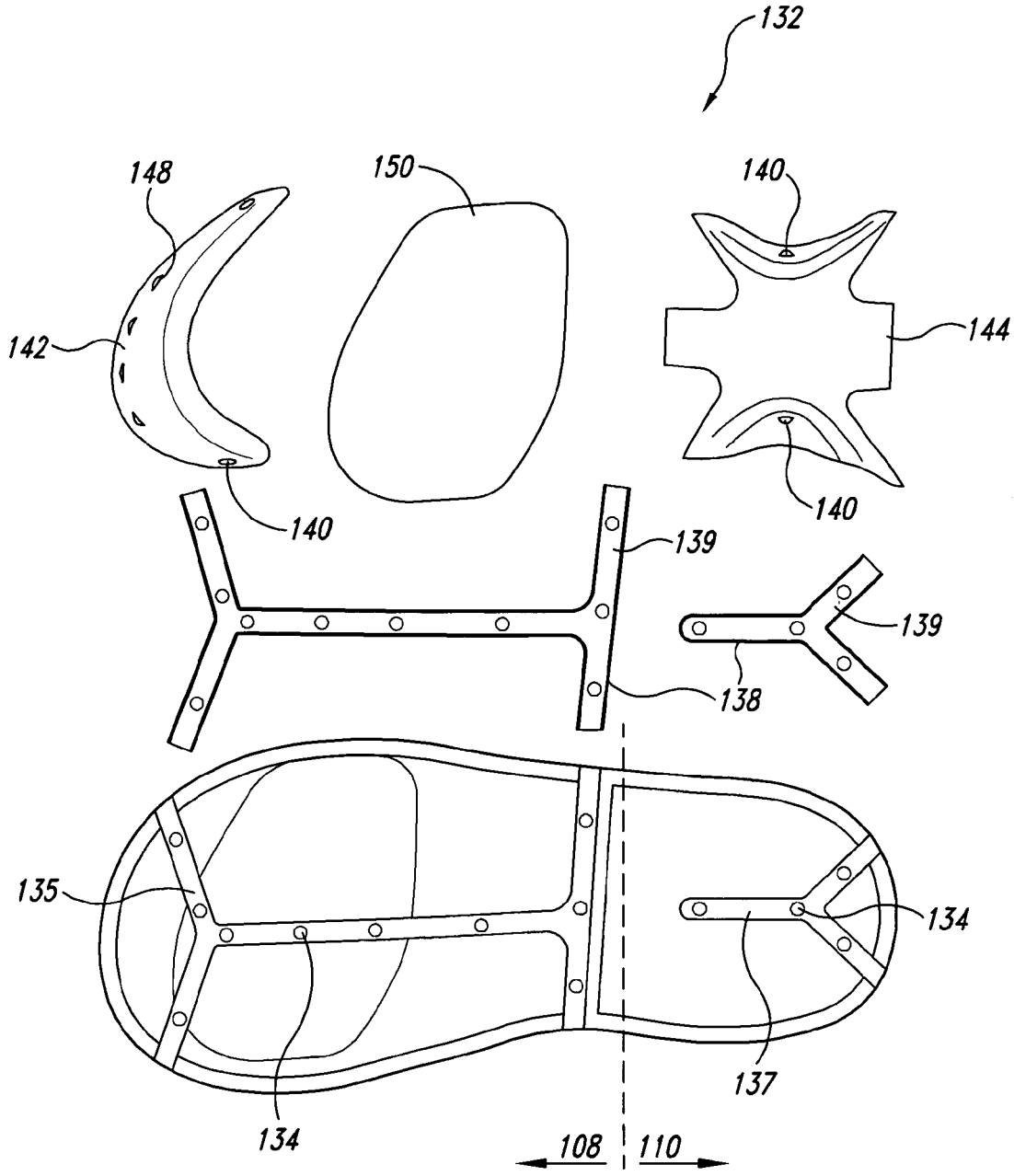
FIG. 19 is an isometric view of a disassembled sole assembly of the sandal of FIG. 17.

The curved forefoot plate 150, best shown in FIG. 19 facilitates a fluid motion when the wearer walks or runs. The curved forefoot plate 150 also helps to maintain a forward acceleration associated with the wearer's stride. The curved forefoot plate 150 shown in FIG. 19 is constructed to be supportive yet flexible. In the illustrated embodiment, the curved forefoot plate 150 is positioned between the midsole component 114 and the outsole component 146 of the sole assembly 104, covering an area that corresponds approximately with the forefoot of the wearer's foot when the sandal is worn. When oriented as worn, the curved forefoot plate 150 is curved slightly upward at both a front portion and a rear portion in a manner so as to allow for a fore and aft rolling action consistent with the wearer's natural gate.

The upper 102 of the second illustrated embodiment, best shown in FIGS. 17 and 18, includes first and second adjustable straps (116 and 118), both connected to the sole assembly 104. The upper 102 also includes a medial side heel support strap 120 and a lateral side heel support strap 122, which are both fixed to and extend from the sole assembly 104 at the rear portion 110 of the sandal 100. The first adjustable strap 116 is fixed at the medial side of the front portion 108 of the sandal 100 and slides through a keeper 124 secured to the lateral side of the sole assembly 104 before crossing back over to the medial side of the sandal 100. At the medial side of the sandal 100, the first adjustable strap 116 is fixed to the medial side heel support strap 120 and then to the lateral side heel support strap 122 before ending in the receiving portion 126 of a fastener 128. The area of the first adjustable strap 116 between the heel support straps (120 and 122) corresponds to the upper portion of the wearer's heel (not shown). In the illustrated embodiment, the first adjustable strap 116 is one continuous strap. In alternate embodiments, the first adjustable strap 116 can have a plurality of interconnected strap segments, such as separate segments connected to the heel support straps (120 and 122).

The second adjustable strap 118 is fixed at the lateral side of the front portion 108 of the sandal 100 and slides through a keeper 124 secured to the medial side of the sole assembly 104. The second adjustable strap 118 ends in an engaging portion 130 of the fastener 128, which can be fastened to the receiving portion 126 of the fastener. In the illustrated embodiment, the effective length of the second adjustable strap 118 can be modified at the engaging portion 130 of the fastener 128 using any one of a variety of techniques so that the wearer's foot can be firmly and evenly secured to the sandal 100. Because the strap system allows for both major and minor adjustment at many locations, it allows for a comfortable fit with many foot types.

Figure 20:
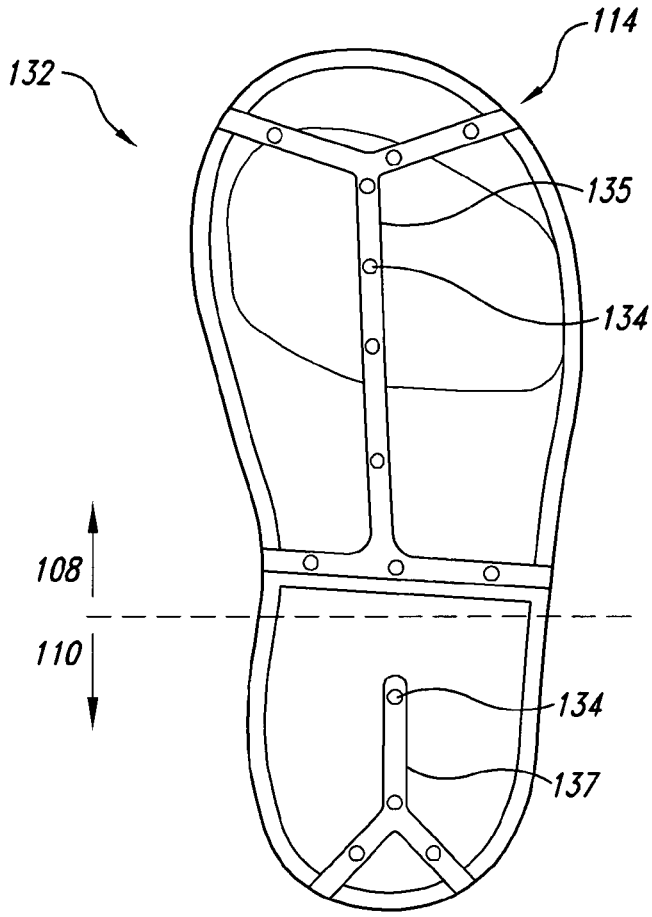
FIG. 20 is a bottom plan view of the midsole component of the sandal associated with the sandal system of FIG. 17.

The sole assembly 104 of the illustrated embodiment includes a fluid drainage system 132, of which portions are best shown in FIGS. 19 and 20. The fluid drainage system 132 is formed by a combination of components, including inlet channels 134 and outlet channels 135 and 137 in the midsole component 114, discrete channel reinforcements 138 positioned in the outlet channel, and one or more outlet apertures 140 in fluid connection with the outlet channels. When the sole assembly 104 is fully assembled, the outsole component 146, the stabilizer 144, and the curved forefoot plate 150 are sealably connected to the midsole component 114 and support the drainage system 132 in place. The outsole component 146, the stabilizer 144 and the curved forefoot plate 150 also provide closure to the bottom sides of the outlet channels 135 and 137 to allow fluid (e.g., air, water, sweat, vapor, etc.) to flow through the sole assembly to the outlet apertures 140.

The drainage system's inlet channels 134 extend substantially vertically (with respect to the orientation of the midsole component 114 when the sandal is worn) through the midsole component 114 from the support surface level 112 of the midsole component. The inlet channels 134 are in fluid communication with the multiple outlet channels 135 and 137 formed in the bottom portion of the midsole component 114. The outlet channels 135 and 137 extend in one or more directions, ultimately toward the outside perimeter of the sole assembly 104. In the illustrated embodiment, the outlet channels 135 and 137 extend approximately horizontally (when the sandal is worn) toward the front, lateral, medial and rear portions of the sandal 100.

In the illustrated embodiment, the first outlet channel 135 is located approximately at the front portion 108 of the midsole component 114 and the second outlet channel 137 is located approximately at the rear portion 110 of the midsole component. From the approximate center of the front portion 108 of the sandal 100, the first outlet channel 135 has a central portion that extends longitudinally before branching out laterally toward the medial and lateral sides of the midsole component 114 at locations approximately corresponding to the arch and toe areas of the wearer's foot. The second outlet channel 137 has a central portion that extends longitudinally before branching out laterally toward the medial and lateral sides of the midsole component 114 at locations approximately corresponding to the heel area of the wearer's foot (not shown).

In the illustrated embodiment, channel reinforcements 138 support the outlet channels. The channel reinforcements 138 have contours corresponding to those of the outlet channels 135 and 137 and a plurality of apertures 139 that align with the inlet channels 134 of the midsole component 114 so fluid can pass through the inlet channels 134 into the outlet channels 135 and 137. The channel reinforcements 138 help keep the outlet channels 135 and 137 open, even when portions of the midsole component 114 are compressed from the weight of the wearer. The channel reinforcements 138 also help to direct fluid through the outlet channels 135 and 137 to the outlet apertures 140 and away from the interior portions of the sole assembly 104 and the wearer's foot (not shown).

Figure 21:
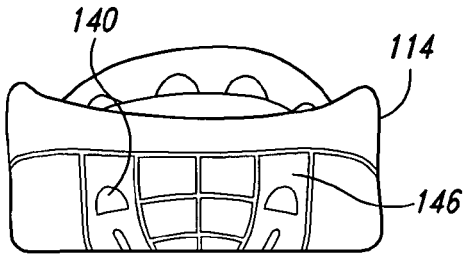
FIG. 21 is a rear elevation view of the sole assembly of the sandal associated with the sandal system of FIG. 17.
Figure 22:
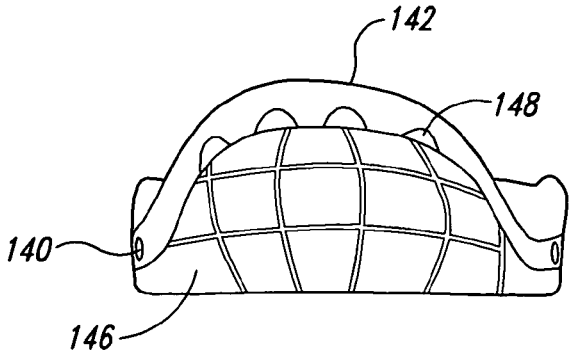
FIG. 22 is a front elevation view of the sole assembly of the sandal associated with the sandal system of FIG. 17.
Figure 23:
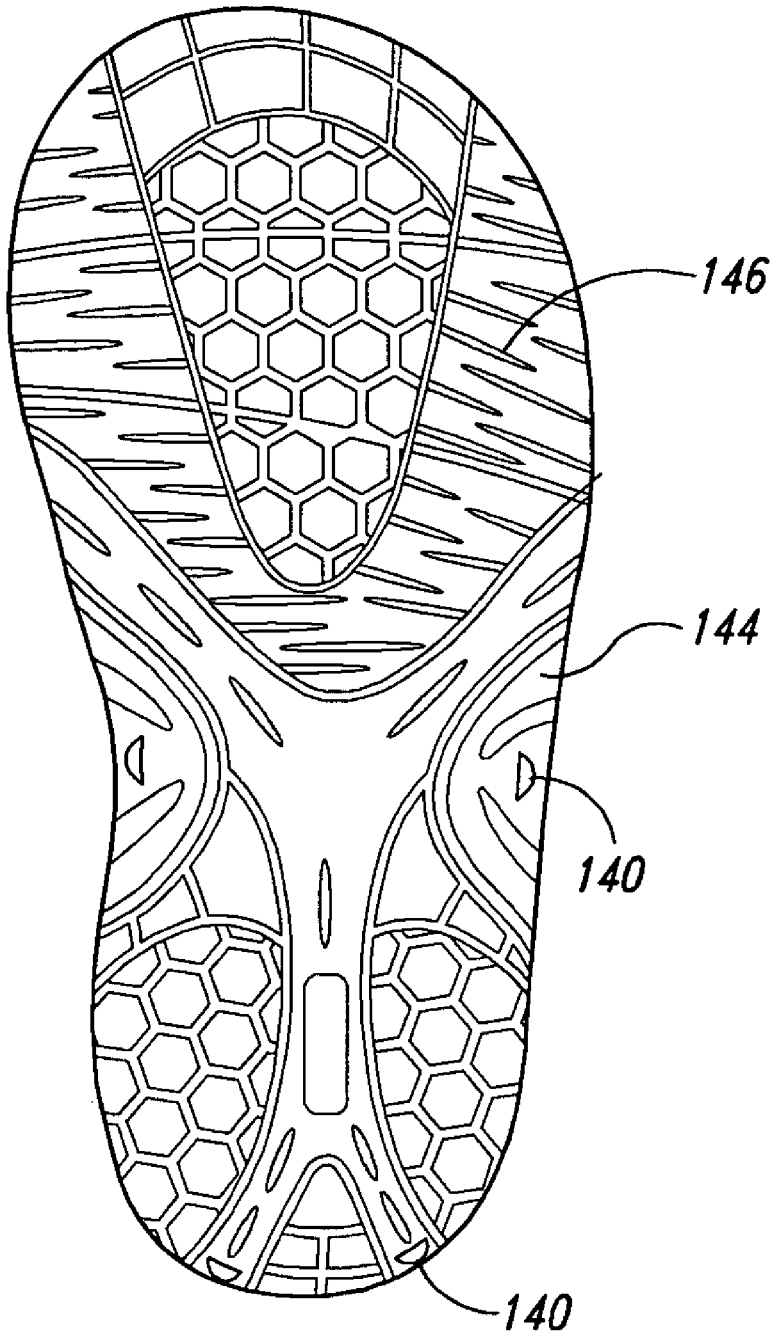
FIG. 23 is a bottom plan view of an outsole component of the sandal associated with the sandal system of FIG. 17.

As best shown in FIGS. 21 through 23, each outlet channel 135 and 137 terminates at one of the outlet apertures 140, which may be located in various portions of the sole assembly 104. In the illustrated embodiment, the outlet apertures are located at the toe guard 142, the arch shank 144, and in the outsole component 146. As the toe guard 142 and arch shank 144 are generally constructed to be less flexible than, for example, the outsole component 146, it may be unnecessary to provide reinforcement around the outlet apertures 140 associated with the toe guard 142 and arch shank 144. However, for outlet apertures 140 located in more flexible areas, such as in the midsole component 114 and outsole component 146, the channel reinforcements 138 of the outlet channels (135 and 137) may extend into the outlet apertures 140 to keep them open under the weight of a wearer. In addition to the outlet apertures 140, as best shown in FIG. 22, the toe guard 142 may include additional drainage apertures 148 that allow for drainage of fluid to and from the foot bed and for increased air circulation, keeping the wearer's foot cooler and dryer.

Fluid drainage can be enhanced when the sandal 100 is combined with a poriferous insole, such as the aquatic insole 86 of FIG. 14. Additionally, because fluid can flow through the drainage system's 132 various apertures, passages and channels, the problem of scooping up fluid is minimized—making walking in submerged areas easier and more comfortable.

From the foregoing, it will be appreciated that specific embodiments of the invention have been described herein for purposes of illustration, but that various modifications may be made without deviating from the spirit and scope of the invention.

The invention claimed is:

1. An athletic sandal system comprising:

a plurality of interchangeable insoles, wherein the plurality of interchangeable insoles includes a porous insole;

a midsole having a peripheral portion and a cavity contoured to receive any one of the plurality of interchangeable insoles, the midsole having an inlet drainage channel extending at least partially therethrough, the inlet drainage channel being in fluid communication with the cavity and the porous insole when in the cavity;

an outsole connected to the midsole substantially opposite the cavity;

an outlet drainage channel connected to the midsole or the outsole, in fluid communication with the inlet drainage channel, and terminating generally adjacent to the peripheral portion of the midsole, the outlet drainage channel and the inlet drainage channel defining an integral liquid drainage system in the sandal, wherein liquid can pass through the inlet drainage channel to the outlet drainage channel and exit the outlet drainage channel where the outlet drainage channel terminates generally adjacent to the peripheral portion of the midsole; and foot retention straps coupled to the midsole adjacent to the cavity.

2. The athletic sandal system of claim 1, further comprising a toe guard having a first aperture in fluid communication with the outlet drainage channel and a second aperture spaced apart from the first aperture, wherein the second aperture permits fluid to pass through the toe guard.

3. The athletic sandal system of claim 1, further comprising a support component between the midsole and the outsole and having an aperture in fluid communication with the outlet drainage channel.

4. A sandal with an integral liquid drainage system, comprising:

a midsole having a upper support portion, a peripheral portion, and an inlet drainage channel in fluid communication with the upper support portion and extending through the midsole in a first direction away from the upper support portion;

an outsole coupled to the midsole;

a outlet drainage channel connected to the midsole or the outsole and in fluid communication with the inlet drainage channel, wherein the outlet drainage channel extends in a second direction different from the first direction; and a drainage aperture substantially adjacent to the peripheral portion of the midsole and in fluid communication with the outlet drainage channel so that liquid can pass through the inlet drainage channel to the outlet drainage channel and from the outlet drainage channel through the drainage aperture, the drainage aperture being positioned at an end of the outlet drainage channel.

5. The sandal of claim 4, further comprising a channel reinforcement positioned internally adjacent to the outlet drainage channel.

6. The sandal of claim 4, further comprising a support component between the midsole and outsole, and wherein a portion of the support component defines a bottom portion of the outlet drainage channel.

7. The sandal of claim 6 wherein the drainage aperture is integrated into the support component.

8. The sandal of claim 4 wherein a portion of the outsole defines a bottom side of the outlet channel.

9. The sandal of claim 4 wherein the drainage aperture is integral to the outsole.

10. The sandal of claim 4, further comprising a toe guard coupled to the midsole, the toe guard having a first aperture in fluid communication with the outlet drainage channel.

11. The sandal of claim 4, further comprising a porous insole removably positioned on the upper support portion of the midsole and in fluid communication with the inlet drainage channel.

12. The sandal of claim 4, further comprising a channel reinforcement positioned internally adjacent to the outlet drainage channel and the drainage aperture, and wherein the drainage aperture is integral to the midsole.

13. The sandal of claim 4 wherein the midsole has a cavity defining the upper support portion and contoured to receive an activity-specific interchangeable insole.

14. An athletic sandal system for receiving a foot of a wearer, the athletic sandal system comprising:

a sandal body comprising a midsole having a contoured cavity;

a plurality of interchangeable insoles each shaped and sized to be removably positioned in the contoured cavity, the insoles include a first insole having a first construction suitable for a first athletic activity and a second insole having a second construction different from the first construction and suitable for a second athletic activity different from the first athletic activity; and a strap secured to the sandal body and positioned to releasably hold any one of the plurality of interchangeable insoles in the contoured cavity.

15. The athletic sandal system of claim 14 wherein the plurality of insoles includes a porous insole having a plurality of insole apertures allowing for fluid to flow through the insole.

16. The athletic sandal system of claim 14 wherein the plurality of insoles includes a cushioned running insole having a heel cushion and an arch support for supporting the foot of a runner.

17. The athletic sandal system of claim 14 wherein the plurality of insoles includes a golf insole with a raised lateral-side portion for assisting with skeletal alignment during golf.

18. The athletic sandal system of claim 14 wherein the first insole is thicker than the second insole.

19. The athletic sandal system of claim 14 wherein the first insole includes a first cushioning layer and wherein the second insole includes a second cushioning layer that is less dense than the first cushioning layer.

20. The athletic sandal system of claim 14 wherein the first insole is more flexible than the second insole.

21. The athletic sandal system of claim 14, further comprising a fluid drainage system, the fluid drainage system comprising:

plurality of inlet drainage channels extending at least partially through the midsole in a first direction;

an outlet drainage channel coupled to the midsole and in fluid communication with the inlet drainage channel, wherein the outlet drainage channel extends in a second direction different from the first direction; and an outlet aperture substantially adjacent to a peripheral portion of the midsole and in fluid communication with the outlet drainage channel.

22. A sandal system with interchangeable insoles, the sandal system comprising:

a plurality of interchangeable insoles including a first insole having a first construction suitable for a first athletic activity and a second insole having a second construction different from the first construction and suitable for a second athletic activity different from the first athletic activity; and a sandal body comprising:

a midsole having a cavity formed by a support surface and a sidewall extending upwardly from the support surface, and wherein the cavity is contoured to singly receive any one of the plurality of interchangeable insoles, the midsole having a strap aperture formed therein adjacent to the support surface; and a foot retention strap having an end portion connected to the midsole and extending from the midsole aperture, the foot retention strap being configured to releasably engage any one of the plurality of interchangeable insoles when positioned in the cavity.

23. The sandal system of claim 22 wherein the midsole aperture is formed in the support surface adjacent to the inside of the sidewall.

24. The sandal system of claim 22 wherein the midsole aperture is formed in an inside portion of the sidewall adjacent to the support surface.

25. The sandal system of claim 22 wherein the midsole aperture is positioned substantially at an intersection of the support surface and the sidewall.

26. The athletic sandal system of claim 22 further comprising a fluid drainage system having:

an inlet drainage channel extending at least partially through the midsole in a first direction;

an outlet drainage channel coupled to the midsole and being in fluid communication with the inlet drainage channel, wherein the outlet drainage channel extends in a second direction different from the first direction; and an outlet aperture substantially adjacent to a peripheral portion of the midsole and in fluid communication with the outlet drainage channel.

27. A method for making an athletic sandal for use in a sandal system with interchangeable insoles, the athletic sandal having a midsole and an upper strap system, the method comprising:

molding the midsole to include a cavity formed by a support surface and a sidewall extending away from the support surface, wherein the cavity is contoured to receive an activity-specific, interchangeable insole;

forming an aperture in the support surface adjacent to the sidewall, wherein the aperture is configured to receive an end portion of the strap system; and positioning the end portion of the strap system in the aperture so that the strap system will releasably engage the insole and retain the insole in the cavity; and securing the end portion of the strap system to the midsole.

* * * * *